US010167724B2

(12) United States Patent
Strohl

(10) Patent No.: US 10,167,724 B2
(45) Date of Patent: Jan. 1, 2019

(54) TURBINE BLADE PLATFORM UNDERCUT WITH DECREASING RADII CURVE

(71) Applicant: CHROMALLOY GAS TURBINE LLC, Palm Beach Gardens, FL (US)

(72) Inventor: James Page Strohl, Stuart, FL (US)

(73) Assignee: Chromalloy Gas Turbine LLC, Palm Beach Gardens, FL (US)

( * ) Notice: Subject to any disclaimer, the term of this patent is extended or adjusted under 35 U.S.C. 154(b) by 196 days.

(21) Appl. No.: 14/972,575

(22) Filed: Dec. 17, 2015

(65) Prior Publication Data

US 2016/0186572 A1 Jun. 30, 2016

Related U.S. Application Data

(60) Provisional application No. 62/124,601, filed on Dec. 26, 2014.

(51) Int. Cl.
*F01D 5/14* (2006.01)

(52) U.S. Cl.
CPC ..... *F01D 5/141* (2013.01); *F01D 5/147* (2013.01); *F05D 2220/30* (2013.01); *F05D 2240/304* (2013.01); *F05D 2240/80* (2013.01); *F05D 2250/294* (2013.01); *F05D 2260/941* (2013.01)

(58) Field of Classification Search
CPC ..... F01D 5/141; F01D 5/147; F05D 2240/80; F05D 2260/941
See application file for complete search history.

(56) References Cited

U.S. PATENT DOCUMENTS

| | | | | |
|---|---|---|---|---|
| 6,390,775 | B1 * | 5/2002 | Paz | F01D 5/14 416/193 A |
| 6,761,536 | B1 * | 7/2004 | Bash | F01D 5/18 416/193 A |
| 6,951,447 | B2 * | 10/2005 | Cherolis | F01D 5/141 416/193 A |
| 7,632,071 | B2 * | 12/2009 | Charbonneau | F01D 5/081 416/193 A |
| 8,287,241 | B2 * | 10/2012 | Strohl | F01D 5/141 416/190 |
| 2014/0150454 | A1 * | 6/2014 | Faulder | F01D 5/141 60/805 |

FOREIGN PATENT DOCUMENTS

| | | | | |
|---|---|---|---|---|
| WO | WO 2014116475 | A1 * | 7/2014 | F01D 5/187 |
| WO | WO 2014160215 | A1 * | 10/2014 | F01D 5/147 |

* cited by examiner

*Primary Examiner* — Jason Shanske
*Assistant Examiner* — Michael Sehn
(74) *Attorney, Agent, or Firm* — Lathrop Gage L.L.P.

(57) ABSTRACT

A turbine blade has an undercut beneath its platform proximate a trailing edge region. The undercut incorporates a curved portion to reduce to reduce undesirable stress concentration. The undercut shape includes a curved portion of decreasing radius with increasing distance from the underside of the platform.

17 Claims, 4 Drawing Sheets

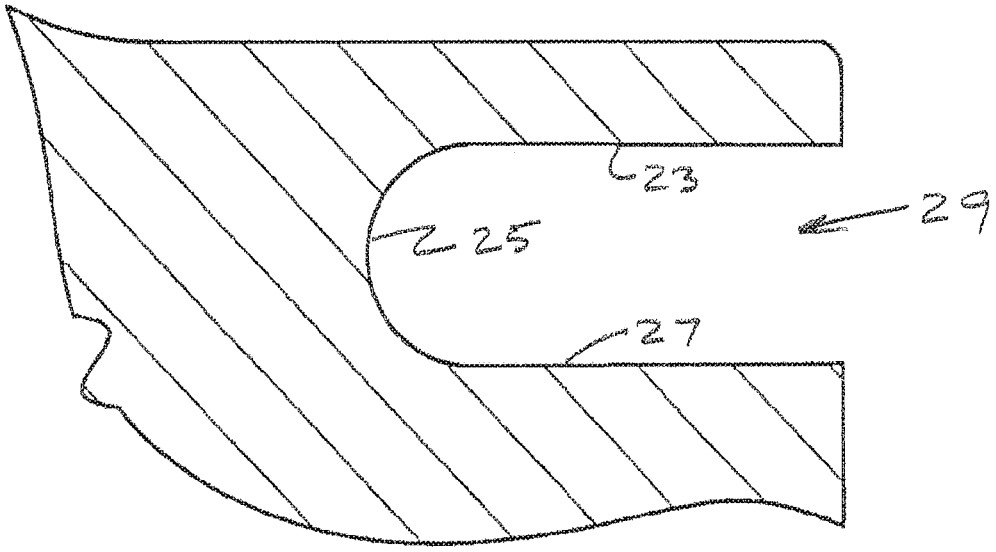
FIG. 2 - PRIOR ART
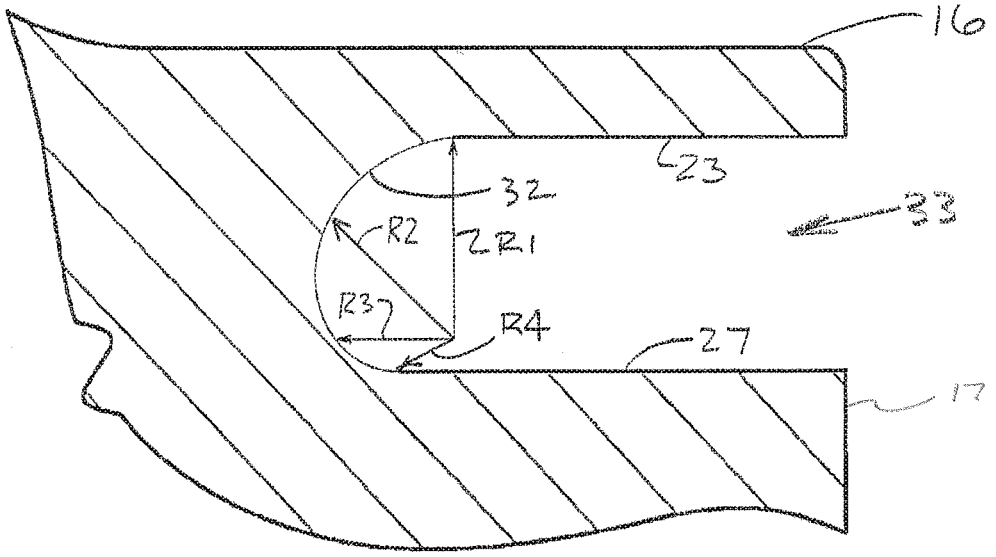
FIG. 3

TURBINE BLADE PLATFORM UNDERCUT WITH DECREASING RADII CURVE

CROSS-REFERENCE TO RELATED APPLICATIONS

This application claims priority to U.S. Provisional Application Ser. No. 62/124,601 filed Dec. 26, 2014.

STATEMENT REGARDING FEDERALLY SPONSORED RESEARCH OR DEVELOPMENT

Not applicable.

TECHNICAL FIELD

This invention disclosure relates generally to a method and apparatus for reducing the stresses located in a turbine blade platform adjacent an airfoil trailing edge region and more specifically to embodiments of a platform undercut for a turbine blade.

BACKGROUND OF THE INVENTION

This invention relates to an undercut beneath the platform of a trailing edge of a turbine blade, wherein the undercut has a shape designed to reduce undesirable stress concentration in the platform.

Turbine blades typically include a platform, with an airfoil extending radially outward from the platform. The airfoil and platform are exposed to thermal stress as they come into contact with heated gasses passing through the turbine. The thermal stresses, as well as the stress caused by the spinning of the turbine blade about the shaft of the gas turbine, create stresses in the turbine blade that can lead to crack formation and propagation in the turbine blade at or near the airfoil/platform interface.

One method of reducing this type of stress is by incorporating an undercut at a trailing edge of the platform under the airfoil. Prior art undercut designs included curves having a single radius, whether used alone, or in combination with other curves having a single radius. While the known undercuts do reduce stress concentrations, single-radius curves leave highly stressed areas adjacent the portion of the radius merging into the platform, and combinations of single radius curves create non-uniform stresses portions of the undercut.

BRIEF SUMMARY OF THE INVENTION

The present invention discloses systems and methods for reducing stress concentrations in a turbine blade platform region. More specifically, in an embodiment of the present invention, a turbine blade comprises a platform and an airfoil extending outwardly from the platform, where the airfoil has a leading edge, a trailing edge, and an undercut formed on an underside of the platform and spaced away from the airfoil. The undercut is positioned generally at an end of the platform adjacent the trailing edge of the airfoil. The undercut connects an underside surface of the platform to a base of the blade and has a curved portion extending from the underside surface of the platform to the base of the blade, where the curved portion has a radius of curvature which decreases with increasing distance from the underside surface of the platform.

In an alternate embodiment of the present invention, a turbine blade is provided comprising a base, a platform extending radially outward from the base, and an airfoil extending radially outward from the platform. The airfoil has a leading edge and an opposing trailing edge, a pressure side surface and an opposing suction side surface, where the pressure side and suction side surfaces extending between the leading edge and the trailing edge. The turbine blade also includes an undercut extending through a portion of the platform, the undercut having an underside surface connected to an upper surface of the base by a curved portion, the curved portion formed by a radius decreasing in size from the underside surface to the upper surface of the base.

In a further embodiment of the present invention, a system for reducing stresses in a base of a rotating turbine blade is provided. The system comprises an undercut extending through at least a portion of a platform of the turbine blade, where the undercut has an underside surface and an upper surface of the base, the surfaces extending generally parallel thereto and a distance into the platform from a trailing edge face of the platform. A curved portion connects the underside surface to the upper surface of the base, where the curved portion is defined by a series of connected radii of decreasing size as measured from the underside surface to the upper surface of the base.

In one particular embodiment, the undercut protrudes more deeply into the platform adjacent the trailing edge of the airfoil than it does under other portions of the trailing edge side of the platform. In each embodiment, the undercut includes a curved portion in which the radius of curvature decreases with increasing distance from the underside of the platform. This curvature distributes stress along the curve without creating stress concentrations of the type that can occur when multiple, single radius curves are used to form a portion of the undercut, which in turn reduces the likelihood of stress corrosion, cracking and thermal mechanical fatigue in the turbine blade.

These and other features of the present invention can be best understood from the following description.

BRIEF DESCRIPTION OF THE SEVERAL VIEWS OF THE DRAWING

The present invention is described in detail below with reference to the attached drawing figures, wherein:

FIG. 2 shows a cross section view of an undercut in accordance with the prior art.

FIG. 3 is a cross section view of an undercut in accordance with an embodiment of the present invention.

DETAILED DESCRIPTION OF THE INVENTION

The present invention is intended for use in a gas turbine engine, such as a gas turbine used for power generation. One such example is the General Electric Frame 7FA gas turbine engine. However, the present invention is applicable to other gas turbines manufactured by General Electric, and more generally to gas turbines used for power generation, regardless of manufacturer. As those skilled in the art will readily appreciate, such an engine is circumferentially disposed about an engine centerline, or axial centerline axis. The engine includes a compressor, a combustion section and a turbine. As is well known in the art, air compressed in the compressor is mixed with fuel which is burned in the combustion section and expanded in turbine. The air compressed in the compressor and the fuel mixture expanded in the turbine can both be referred to as a "hot gas stream flow." The turbine includes rotors that, in response to the expansion, rotate, driving the compressor. The turbine comprises alternating rows of rotary turbine blades, and static airfoils, often referred to as vanes.

Figure 1:
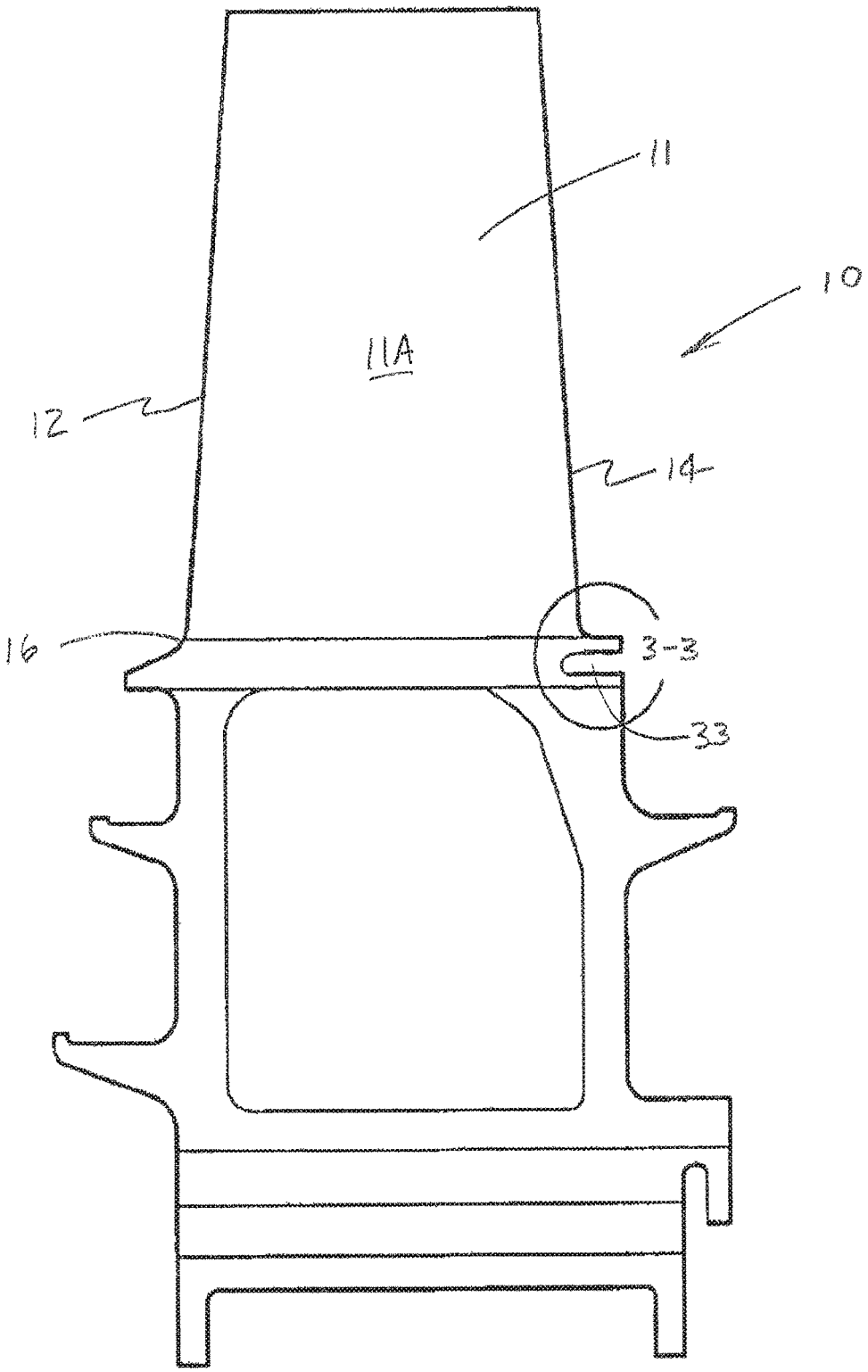
FIG. 1 shows an elevation view of a turbine blade in accordance with an embodiment of the present invention.

A turbine blade in accordance with embodiments of the present invention is shown in FIGS. 1 and 3-5. Referring initially to FIG. 1, the turbine blade 10 has an airfoil portion 11 extending from a leading edge 12 to a trailing edge 14 where the airfoil includes a pressure side surface 11A and an opposing suction side surface 11B. A platform 16 supports the airfoil 11. An undercut 33 in accordance with the present invention is shown beneath the platform 16 at the trailing edge 14.

One of the prior art undercuts 29 is shown in FIG. 2 as having a single radius portion 25 connecting a lower, or underside surface 23, of the platform 16 and an upper surface 27 of a base for the blade 10. As discussed above, the purpose of the prior art undercut is to reduce thermal stress concentration in the platform 16. However, the area where the single radius 25 merges with the lower surface 23 of the platform 16 remains a high thermal stress area, and may be the highest thermal stress area in this prior art blade. Thus, although the undercut 29 does provide benefit in reducing heat stress at the platform 16, there is still the possibility of stress corrosion cracking and thermal mechanical fatigue.

Referring now to FIG. 3, an embodiment of the present invention is shown in more detail. Here, an undercut 33 extends into the platform 16 from a trailing edge face 17 of the platform 16. The undercut 33 is formed by connecting the generally parallel surfaces 23 and 27 and also includes a curve 32 having a continuously decreasing radius of curvature with increasing distance from the underside 23 of the platform 16. As shown in FIG. 3, the radius is greatest (R1) at that portion of the curve 32 tangent to the underside surface 23 of the platform 16, and decreases continuously (as depicted by radii R2, R3, and R4, with R4 being the smallest radius) as the distance increases from the underside surface 23 of the platform 16. Preferably, the radius of the curve is defined in polar coordinates by the following relationship:

$$R=(1-[0.014\times T^3])\times K$$

Where:

T=the angle Theta in radians measured from 0.5π to 1.1667π on standard polar coordinates.

K=a scaling constant.

As one skilled in the art will understand, the radius R is a function of the constant K and K is selected such that sufficient material remains in platform 16, both above and below the undercut 33, so as to not compromise the structural integrity of the turbine blade. The size and location of the undercut 33 can vary depending on a series of parameters. For example, in one embodiment the undercut 33 extends across the width of platform 16 from a pressure side face to a suction side face. In an alternate embodiment, the undercut 33 is tapered such that it extends from a pressure side face of the platform 16 to a trailing edge face 17 of the platform. Furthermore, in yet another embodiment, the undercut 33 extends a depth into the platform 16 a function of its distance from the trailing edge 14 of the airfoil 11.

For example, one such undercut may be utilized in a first stage turbine blade. In this arrangement, an undercut would result in a platform thickness above the undercut (closest to the airfoil) of approximately 0.11 inches and a thickness of approximately 0.19 inches below the undercut. The undercut also extends a distance into the turbine blade from the trailing edge face 17 approximately 0.55 inches. One skilled in the art of turbine blade design will understand that other undercut sizes are possible given various turbine blade geometries while also adhering to the undercut design principles disclosed herein.

Figure 4:
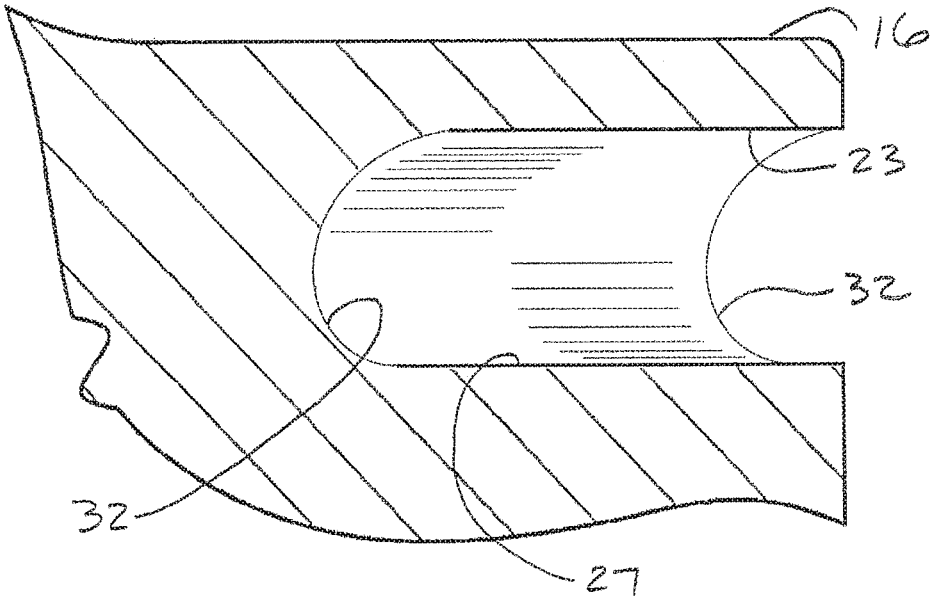
FIG. 4 shows an alternate embodiment of the undercut of the present invention.
Figure 5:
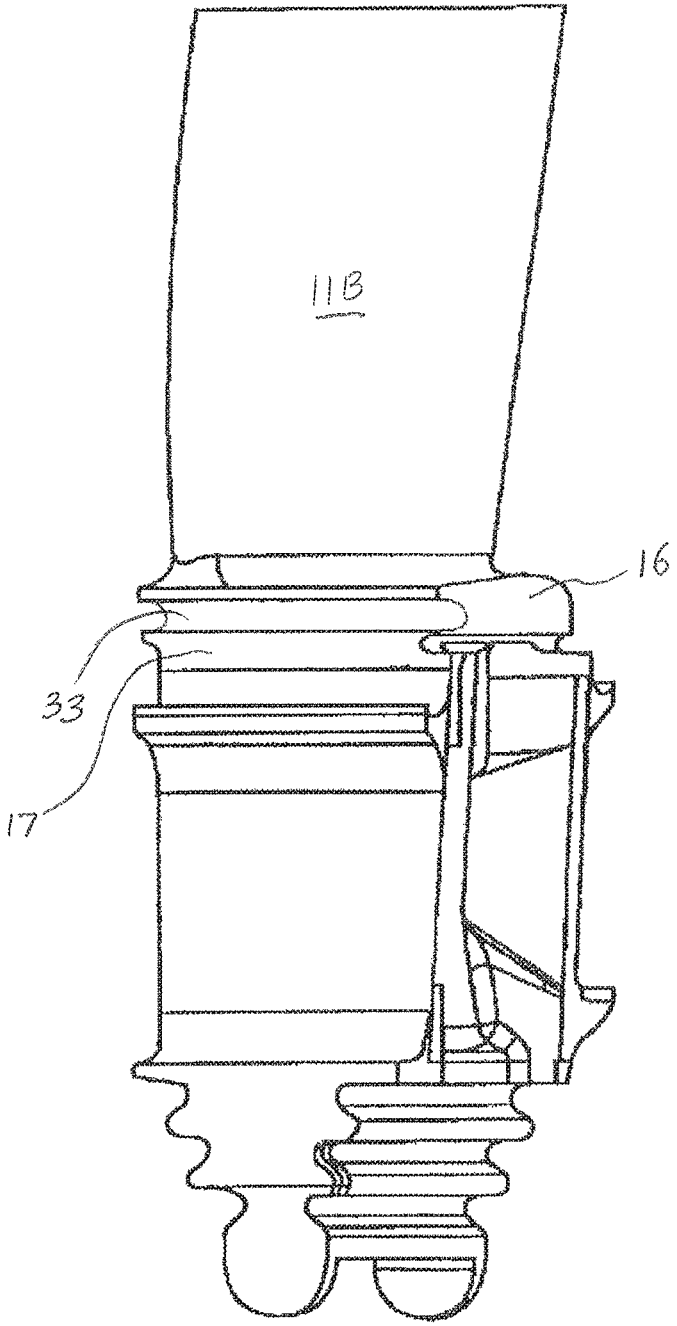
FIG. 5 shows a perspective view of the turbine blade of FIG. 1.

Although the undercut 33 of the present invention, as shown in FIGS. 3 and 5, extends a constant depth into the platform 16 across the entire span of the trailing edge face 17 of the platform 16, in an alternate embodiment of the present invention the undercut may be skewed such that the depth of the undercut 33 decreases with increasing distance from the trailing edge 14 of the airfoil 11. In this case, as shown in FIG. 4, the depth of the upper and lower surfaces 23, 27 may decrease to the point that by the time the undercut reaches the platform 16 face at the opposite side of the platform 16, only the curve 32, or a portion thereof, of the undercut 33 may actually extend into the platform 16. This alternate embodiment may be useful in situations where the stresses in the portions of the platform 16 distant from the trailing edge 14 of the airfoil 11 are not high enough to warrant concern, or where conductive heat transfer in that area is more desirable than the benefits associated with an undercut 33 having a constant depth across the entire length of the trailing edge side of the platform 16.

As those skilled in the art will readily appreciate, the shape of the curve 32 is the same regardless of the value chosen for the scaling constant K, as the scaling constant is simply used to increase or decrease the scale of the curve 32 so that the point on the curve 32 at 0.5π lies on surface 23 of the undercut 33 and the point on the curve 32 at 1.1667π lies on surface 27 of the undercut 33.

The stresses in the curve 32 of the undercut 33 depend in part upon the depth of the undercut 33 into the platform 16. As the depth of the undercut 33 becomes deeper, the stress in the curve 32 increases. In the present embodiment, the undercut 33 is extended into the line of stress created by the blade airfoil load (centrifugal forces) when the turbine blade is spinning, so that the portion of the platform 16 immediately above the undercut 33 is less constrained and has more freedom to respond to thermal stresses and blade load stresses thereby relieving those stresses that might otherwise initiate cracking or propagate cracking in the turbine blade 10 adjacent the trailing edge 14 of the airfoil.

The undercut 33 of present invention, with the radius of its curve 32 varying as described in the equation set forth above (i.e. a continuously decreasing radius of curvature with increasing distance from the underside of the platform 16) avoids the change in stress concentration that occurs when multiple constant radius curves are used to form the curved portion of an undercut, and is more effective in distributing stress than a single constant radius curve of the prior art. Accordingly, the likelihood of stress corrosion, cracking or thermal mechanical fatigue is reduced.

Undercut 33 can be placed into platform 16 through a variety of processes. For newly manufactured turbine blades, the undercut 33 can be cast into the turbine blade or it can be machined into the blade casting. Due to the unique and specific nature of the undercut 33, a precise manufacturing process, such as electrical discharge machining or EDM, is suggested for machining the undercut into the turbine blade. Given the location of the undercut 33, the addition of this undercut can also be applied to previously-run turbine blades.

Although a preferred embodiment of this invention has been disclosed, a worker of ordinary skill in this art would recognize that certain modifications would come within the scope of this invention. For that reason, the following claims should be studied to determine the true scope and content of this invention. Since many possible embodiments may be made of the invention without departing from the scope thereof, it is to be understood that all matter herein set forth or shown in the accompanying drawings is to be interpreted as illustrative and not in a limiting sense.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Having thus described the invention, what is claimed is:

1. A turbine blade comprising a platform, an airfoil extending outwardly from the platform, the airfoil having a leading edge and a trailing edge, and an undercut formed on an underside of the platform and spaced away from the airfoil, the undercut being on an end of the platform adjacent the trailing edge of the airfoil, the undercut connecting an underside surface of the platform to a base of the blade, the undercut having a curved portion extending from the underside surface of the platform to the base of the blade, wherein the curved portion has a radius of curvature which decreases continuously at each point of the curved portion with increasing distance from the underside surface of the platform.

2. The turbine blade of claim 1, wherein the radius of curvature is greatest at a part of the curved portion tangent to the underside surface of the platform.

3. The turbine blade of claim 1, wherein the radius of curvature is smallest at a part of the curved portion tangent to the base of the blade.

4. The turbine blade of claim 1, wherein the radius of curvature is a function of an angle measured in radians and a scaling constant.

5. The turbine blade of claim 1, wherein the underside surface of the platform is generally parallel to the base of the blade.

6. The turbine blade of claim 1, wherein the undercut extends a width of the platform from a pressure side to an opposing suction side.

7. The turbine blade of claim 1, wherein the undercut extends from a pressure side of the platform to a trailing edge face of the platform.

8. The turbine blade of claim 1, wherein the undercut extends a depth into the platform that varies as a function of distance from the trailing edge of the airfoil.

9. The turbine blade of claim 1, wherein the undercut is cast or machined into the turbine blade.

10. A turbine blade comprising:

a base;

a platform extending radially outward from the base;

an airfoil extending radially outward from the platform, the airfoil having a leading edge and opposing trailing edge, a pressure side surface and an opposing suction side surface, the pressure side and suction side surfaces extending between the leading edge and the trailing edge; and, an undercut extending through a portion of the platform, the undercut having an underside surface connected to an upper surface of the base by a curved portion, the curved portion formed by a radius of curvature continuously decreasing in size at each point of the curved portion from the underside surface to the upper surface of the base.

11. The turbine blade of claim 10, wherein the radius of curvature is a function of an angle measured in radians and a scaling constant.

12. The turbine blade of claim 11, wherein the radius of curvature is greatest at a part of the curved portion tangent to the underside surface of the platform.

13. The turbine blade of claim 10, wherein the radius of curvature is smallest at a part of the curved portion tangent to the base of the blade.

14. The turbine blade of claim 10, wherein the undercut is proximate the airfoil trailing edge.

15. A turbine blade comprising a platform, an airfoil having a leading edge and a trailing edge, and an undercut formed on an underside of the platform and spaced away from the airfoil, the undercut being on an end of the platform adjacent the trailing edge and connecting an underside surface of the platform to a base of the blade, a curved portion of the undercut extending from the underside surface to the base;

wherein:

the curved portion has a radius of curvature which continuously decreases at each point of the curved portion with increasing distance from the underside surface of the platform; and the undercut extends a depth into the platform that varies as a function of distance from the trailing edge of the airfoil.

16. The turbine blade of claim 15, wherein the undercut is machined into the blade.

17. The turbine blade of claim 16, wherein a thickness of the platform above the undercut is about 0.11 inches.

* * * * *